US006544073B2

(12) United States Patent
Kieninger et al.

(10) Patent No.: US 6,544,073 B2
(45) Date of Patent: Apr. 8, 2003

(54) CONNECTOR WITH FUSE

(75) Inventors: Hans Kieninger, Stuttgart (DE); Rudolf Andraschko, Pluderhausen (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/015,417

(22) Filed: Dec. 13, 2001

(65) Prior Publication Data

US 2002/0076984 A1 Jun. 20, 2002

(30) Foreign Application Priority Data

Dec. 16, 2000 (DE) ..... 100 62 938

(51) Int. Cl.[7] ..... H01R 13/68
(52) U.S. Cl. ..... 439/622
(58) Field of Search ..... 439/621, 622

(56) References Cited

U.S. PATENT DOCUMENTS 4,738,639 A 4/1988 Henderson
5,018,991 A * 5/1991 Katz et al. ..... 439/621
6,020,656 A 2/2000 Fildan
6,162,098 A * 12/2000 Cheng et al. ..... 439/621

FOREIGN PATENT DOCUMENTS

DE G9409851.4 9/1994
DE 29803586 U1 6/1998
DE 20001870 U1 5/2000

* cited by examiner

*Primary Examiner*—Tho D. Ta
(74) *Attorney, Agent, or Firm*—Roger C. Turner

(57) ABSTRACT

A connector is described, with a receiver (11) at the rear end that receives and terminates to a cable conductor (12), with a contact (15) at the front end, and with an electrical fuse (16) between the receiver and contact. The fuse has front and rear fuse terminals (42, 43). A threaded connection between a contact threaded stud part (52) and a threaded coupling (23) in the receiver can draw the contact and receiver together and clamp the fuse terminals between contact and receiver. An insulator (24) surrounds the threaded tube to mechanically fix the threaded coupling to the receiver while electrically isolating one from the other. The receiver has a rear end crimped around the cable conductor and a front end crimped around the insulator.

12 Claims, 3 Drawing Sheets

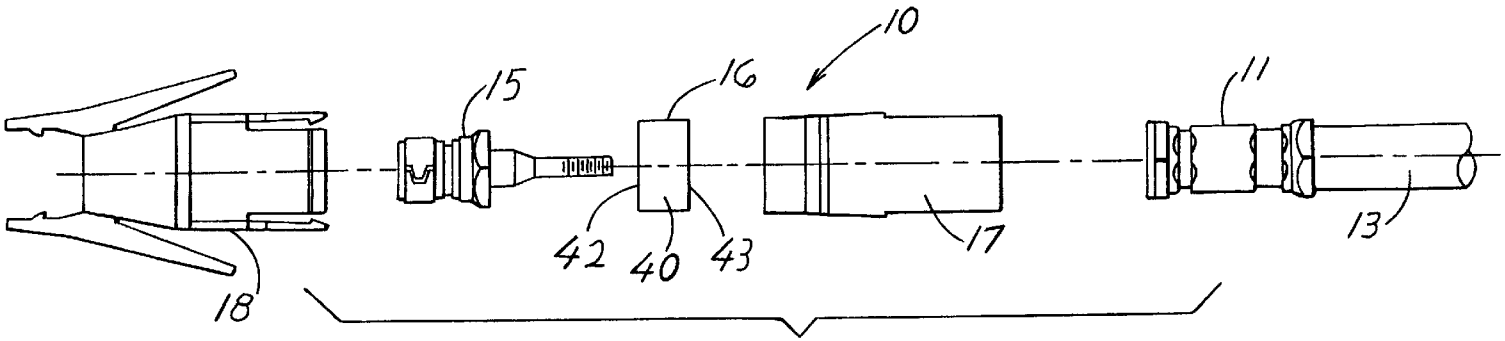
FIG. 1
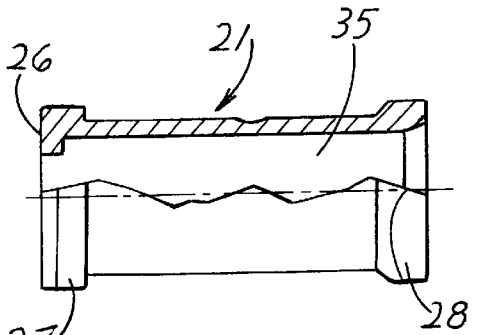
FIG. 2
FIG. 3
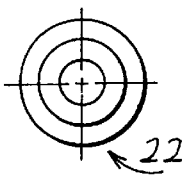
FIG. 4
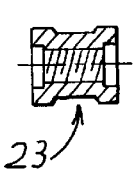
FIG. 5
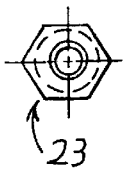
FIG. 6
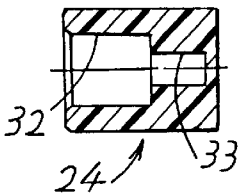
FIG. 7
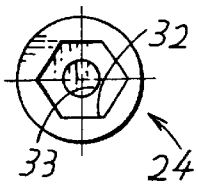
FIG. 8

CONNECTOR WITH FUSE

BACKGROUND OF THE INVENTION

Vehicles commonly include an electrical fuse with one fuse terminal engaged with a receiver that crimps to a cable conductor, and with the other fuse terminal constructed as a cable lug that clamps to a battery terminal of the vehicle battery. Such prior art arrangements are relative expensive and complicated, both in construction and in the replacement of the electrical fuse. A high current connector with electrical fuse, that was of simple construction and that facilitated replacement of a fuse, would be value.

SUMMARY OF THE INVENTION

In accordance with one embodiment of the present invention, a high current connector with fuse is provided, which is of simple and low cost construction and which facilitates replacement of a fuse. The connector has a rear portion with a receiver that receives a cable conductor, the connector has a front portion formed by a contact, and the connector has a fastener such as a threaded stud that mechanically fastens the contact to the receiver while electrical isolating them. The fuse has front and rear fuse terminals that respectively abut the contact and the receiver. The fastener can be tightened to clamp the fuse between the contact and receiver so as to provide an electrical connection through the fuse.

The fastener assembly includes a metal threaded tube forming a threaded coupling lying within the receiver, and an insulator that positions the coupling within the receiver and that prevents axial movement or rotation of the coupling. The receiver has a rear portion crimped around the cable conductor and a front portion crimped around the insulator.

The novel features of the invention are set forth with particularity in the appended claims. The invention will be best understood from the following description when read in conjunction with the accompanying drawings.

BRIEF DESCRIPTION OF THE DRAWINGS

FIG. 1 is an exploded side elevation view of a connector of the present invention, with the receiver sleeve shown crimped to a cable and to an insulator.

FIG. 2 is a partially sectional side view of the receiver sleeve of FIG. 1, prior to crimping.

FIG. 3 is a sectional side view of an insulative bushing of the connector of FIG. 1.

FIG. 4 is a front elevation view of the insulative bushing of FIG. 3.

FIG. 5 is a sectional side view of a threaded tube coupling of the connector of FIG. 1.

FIG. 6 is an end elevation view of the threaded coupling of FIG. 5.

FIG. 7 is a sectional side view of an insulative socket of the connector of FIG. 1.

FIG. 8 is a front view of the insulative socket of FIG. 7.

DESCRIPTION OF THE PREFERRED EMBODIMENTS

Figure 9:
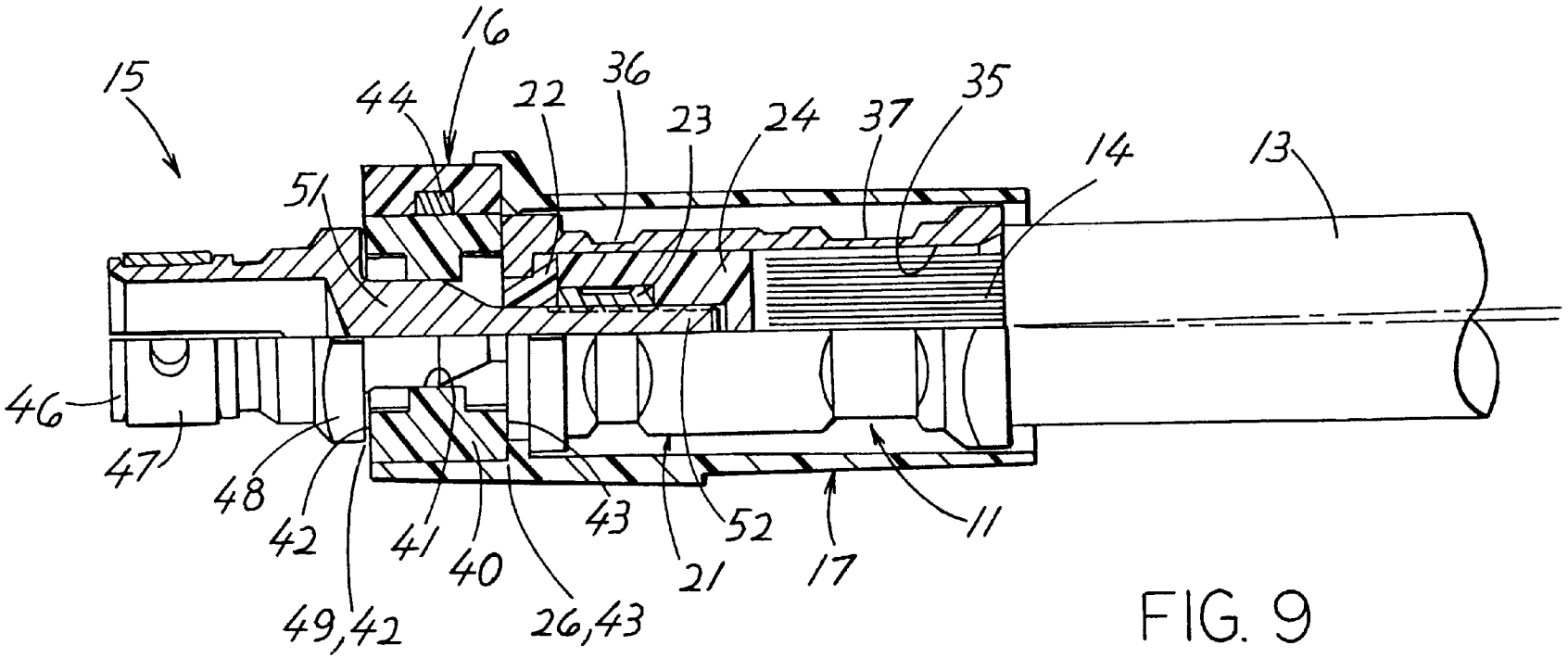
FIG. 9 is a partially sectional side view of the connector of FIG. 1.
Figure 10:
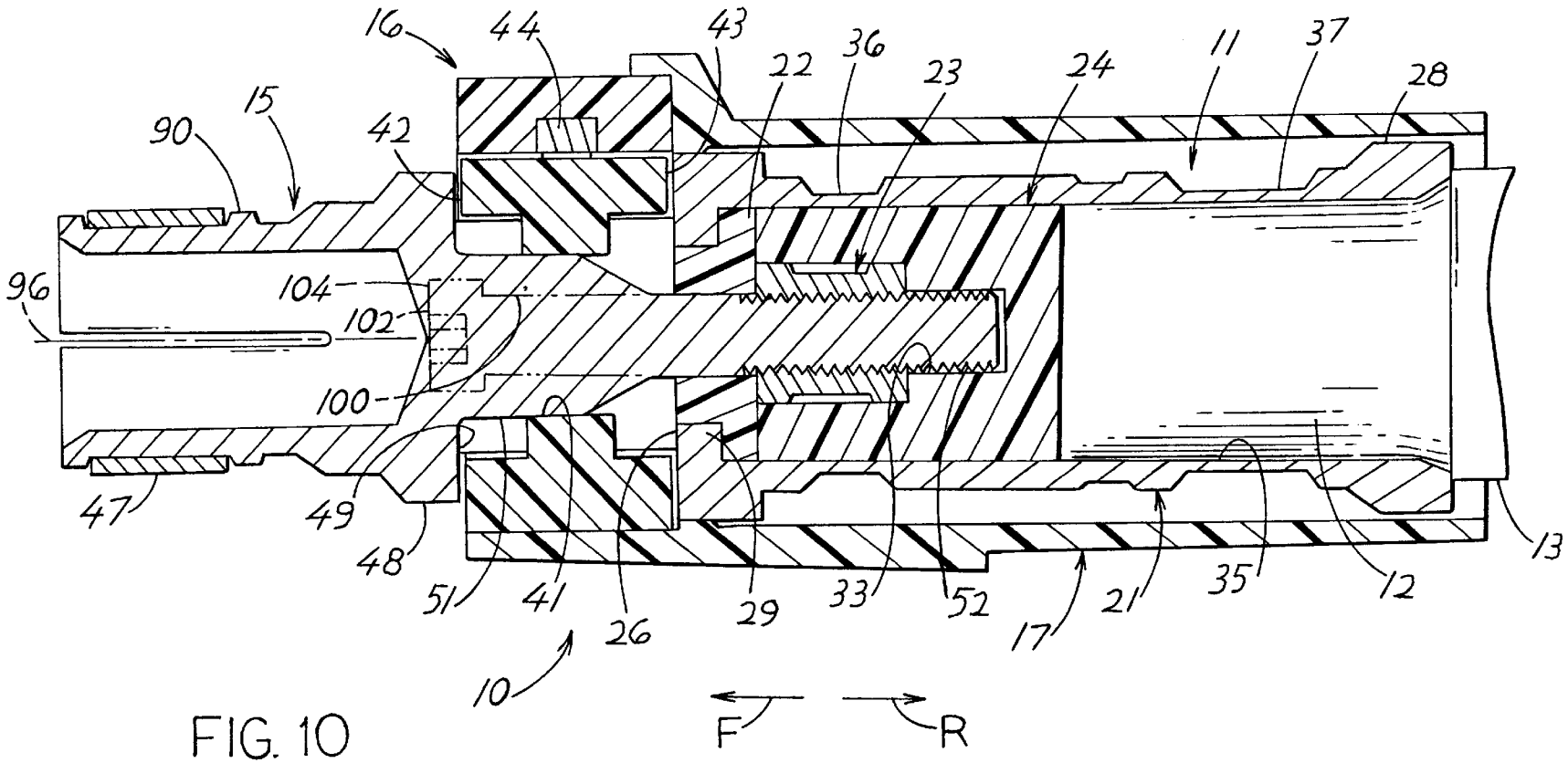
FIG. 10 is an enlarged sectional view of the connector of FIG. 9.

FIG. 10 illustrates a connector 10 with a receiver 11 for receiving and electrically connecting to a cable conductor 12 of a cable 13. The connector also includes a contact 15 which is illustrated as having a front end 90 of a socket type, with a spring ring 47 although it could be a pin type. The connector includes a fuse 16 that connects the receiver 11 to the contact 15, the fuse having a fuseable component 44 that opens the connection when more than a predetermined current passes through it. The connector is designed to enable easy replacement of a fuse 16.

The connector is designed so its rear portion can be inserted into a rear housing part 17, and so the connector can be latched and unlatched from a front housing part shown at 18 in FIG. 1. The front housing part 18 is designed to be clamped to a battery terminal (not shown).

FIG. 10 shows that the receiver 11 includes a sleeve 21 and an internally threaded tubular coupling 23 lying within the sleeve on a connector axis 96. The threaded coupling 23 lies within an insulator socket 24, and the front end of the coupling abuts an insulator bushing 22. The contact 15 has a rear threaded stud part 52 that is screwed into the threaded coupling 23. Bayonet screw threads could be used. The contact has a hexagonal outer surface at 48 so the contact can be turned to screw the stud part 52 into the threaded coupling 23.

The fuse 16 has a pair of axially-spaced terminals 42, 43 that lie between a rearwardly-facing shoulder 49 on the contact and a forwardly-facing shoulder 26 on the sleeve. When the hex surface 48 is turned, and the fuse is clamped tighter between the sleeve and contact shoulders 26, 49, good electrical connections are established between the contact shoulder 49 and the fuse terminal 42 and between the sleeve shoulder 26 and the fuse terminal 43.

To prevent turning of the threaded coupling 23, applicant constructs it with a hexagonal outside, as shown in FIG. 6. As shown in FIGS. 7 and 8, applicant inserts the threaded coupling into a hexagonal bore 32 in the insulator socket 24. Also, as shown in FIG. 10, applicant provides a hexagonal crimp at 36 that prevents rotation of the insulator socket 24 with respect to the sleeve 21. The large diameter of the periphery of the insulator 24 helps prevent insulator rotation. The insulator bushing 22 abuts a sleeve inner flange 29 to prevent forward F movement of the threaded coupling. It is noted that the insulator socket 24 has a blind hole 33 into which the threaded stud part 52 can move.

To assemble the connector, applicant first assembles the combination of threaded coupling 23, insulator socket 24 and insulator bushing 22 and inserts them forwardly F through an inside or passage 35 of the sleeve, to the final positions shown in FIG. 10. The insulator socket 24 fits closely within the sleeve, to facilitate later crimping. Applicant then inserts the bared cable conductor 12 into the rear portion of the sleeve. Applicant then establishes crimps at 36 and 37. The crimp at 37 mechanically and electrically connects the cable conductor 12 to the sleeve. The crimp at 36 prevents rotation of the insulator socket 24 with respect to the sleeve. Applicant then prefers to place the rear housing part 17 around the sleeve and insert the fuse 16 into the front of the rear housing part 17, as shown. Then, the threaded stud part 52 at the rear end of a pin portion 51 of the contact, is inserted through a hole 41 in the fuse and through a hole in the insulator bushing 22, and applicant turns the contact to thread the stud part 52 through the threaded coupling 23 and move it rearwardly R. A wrench applied to the hex surface 48 on the contact front portion, is turned until the shoulders 49, 26 on the contact and on the sleeve tightly clamp the fuse terminals 42, 43 between them.

The front housing part 18 shown in FIG. 1 can be pressed rearwardly around the rear contact part 17, and the front housing part 18 is then ready for mounting on a vehicle battery terminal or other device.

FIG. 10 shows, in phantom lines, an alternative construction wherein a bore 100 is formed through the contact 15, and a screw 102 is inserted through the bore. The screw forms the threaded stud part 52 and the screw has a head 104 that abuts the contact part.

Thus, the invention provides a connector with a fuse, for connecting to a cable conductor, which is easily assembled and which facilitates replacement of a blown fuse. The connector includes a sleeve with a largely forwardly-facing shoulder, a contact with a largely rearwardly-facing shoulder, and a fuse with terminals that are clamped tightly between the shoulders on the sleeve and contact. A fastener which is formed on the contact or on a separate screw or the like, passes through a hole in the fuse and is threadably connected to a threaded coupling lying in the sleeve. The threaded coupling is captured in an insulator socket that lies within the sleeve. The sleeve has two crimps, including a rear crimp around a rear cable conductor and a front crimp around the insulator socket.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A fuse connector for terminating to a cable conductor, comprising:

a metal sleeve that receives and is connectable to the cable conductor, said sleeve having a largely forwardly-facing shoulder;

a metal contact having a front mating front portion and having a largely rearwardly-facing shoulder;

an electrical fuse having a pair of electrical terminals, one of said terminals lying against said forwardly-facing shoulder and the other of said terminals lying against said rearwardly-facing shoulder;

said contact being releaseably mechanically connected to said sleeve but electrically isolated from said sleeve, to clamp said fuse terminals between said shoulders.

2. The connector described in claim 1 wherein:

said contact has a front end; and including a coupling that is threadably coupled to said contact and that is fixed to said sleeve against turning and against sliding toward said contact front end.

3. The connector described in claim 2 wherein:

said coupling is formed of metal and lies within said sleeve front portion, and including an insulator fixed in said sleeve, said coupling being fixed in said insulator.

4. The connector described in claim 3 wherein:

said sleeve front portion is crimped around said insulator.

5. The connector described in claim 1 including:

a coupling in the form of a tube with an inside which is threaded, said contact rear end forms a threaded stud portion that is threadably engaged with said tube.

6. The connector described in claim 5 wherein:

said connector including a first metal part with a hole, and a second metal part in the form of a screw that projects through said hole and that has a head abutting said first part and a threaded shank threadably engaged with said tube.

7. The connector described in claim 6 wherein:

said contact includes a first part with a through bore and a second part with a threaded end.

8. A fuse connector, comprising:

a contact having a largely rearwardly-facing shoulder;

a rear cable connector having a sleeve which receives a cable conductor, said sleeve having a largely forwardly-facing shoulder;

a fuse having front and rear fuse terminals;

a threaded coupling that is fixed to said rear cable connector against rotation and against forward movement;

connection means that is coupled to said contact and to said rear cable connector in a threadable connection to clamp said fuse terminals between said shoulders.

9. The connector described in claim 8 wherein:

said contact has a threaded stud;

said connector means includes a metal tube with an internal thread that is threadable connected to said threaded stud, and said connection means includes an insulator which connects said metal tube to said rear cable connector.

10. The connector described in claim 7 wherein:

said rear cable connector comprises a sleeve that has a front end with an internal flange, said sleeve having an open rear end; and including a threaded metal coupling and an insulator that surrounds said threaded coupling and that fits into said sleeve through the sleeve open rear end and against said flange.

11. The connector described in claim 10 wherein:

said insulator includes an insulator socket that has a first passage portion that surrounds said threaded coupling, and a rear passage portion that extends rearward and in line with said first passage portion, and said insulator includes a front bushing with a hole that is aligned with said passage portions, said front bushing abutting said flange.

12. A fuse connector for terminating to a cable conductor, comprising:

a metal contact with a largely rearwardly-facing shoulder;

a fuse having front and rear terminals;

a metal sleeve with a largely forwardly-facing shoulder, said sleeve having front and rear portions;

an internally threaded coupling lying within said sleeve front portion, said coupling having a noncircular outer surface portion;

an insulator lying within said sleeve front portion and having a passage with a noncircular passage portion surrounding said coupling;

said contact has a threaded stud portion that is threadably engaged with said coupling, to clamp said fuse between said shoulders;

said cable conductor lying in said sleeve rear portion;

said sleeve front and rear portions both being crimped, to lock said insulator against rotation and to mechanically and electronically lock to said cable conductor.

* * * * *